US005104110A

United States Patent [19]

Haibara

[11] Patent Number: 5,104,110

[45] Date of Patent: Apr. 14, 1992

[54] FEED CONTROL SYSTEM FOR A PRINTER HAVING TWO SHEET FEED MECHANISMS THAT CAN OPERATE AT DIFFERENT SPEEDS

[75] Inventor: Takuzo Haibara, Shizuoka, Japan

[73] Assignee: Tokyo Electric Co., Ltd., Tokyo, Japan

[21] Appl. No.: 723,399

[22] Filed: Jun. 28, 1991

[30] Foreign Application Priority Data

Jun. 29, 1990 [JP] Japan ..... 2-171531

[51] Int. Cl.[5] ..... B65H 3/44; B65H 5/26

[52] U.S. Cl. ..... 271/9; 271/265; 271/270

[58] Field of Search ..... 271/9, 265, 270, 202, 271/203

[56] References Cited

U.S. PATENT DOCUMENTS

| | | | |
|---|---|---|---|
| 4,789,258 | 12/1988 | Gomoll et al. | 271/9 |
| 4,918,489 | 4/1990 | Yagishita et al. | 271/9 |
| 4,939,554 | 7/1990 | Airabayashi et al. | 271/9 |
| 5,018,718 | 5/1991 | Matsuno et al. | 271/270 |

FOREIGN PATENT DOCUMENTS

| | | | |
|---|---|---|---|
| 37-157149 | 7/1962 | Japan . | |
| 0115533 | 9/1980 | Japan | 271/9 |
| 0077135 | 5/1982 | Japan | 271/9 |
| 63-147738 | 6/1988 | Japan . | |

*Primary Examiner*—H. Grant Skaggs

*Attorney, Agent, or Firm*—Oblon, Spivak, McClelland, Maier & Neustadt

[57] ABSTRACT

A printer comprises a first sheet feed mechanism comprising a first transportation unit and a first sheet container, and a second sheet feed mechanism comprising a second transportation unit and a second sheet container. A sheet fed from the second sheet container is transported by the second transportation unit to the first transportation unit. The insertion of a sheet fed from the second sheet container into the first transportation unit is detected by a sheet detector. The feed speed of the second transportation unit is adjusted to a feed speed higher than that of the first transportation unit before the sheet detector detects the leading edge of a sheet fed from the second sheet container. The feed speed of the second transportation unit is adjusted to a feed speed not higher than that of the first transportaton unit upon the detection of the leading edge of the sheet fed from the second sheet container by the sheet detector.

5 Claims, 4 Drawing Sheets

FEED CONTROL SYSTEM FOR A PRINTER HAVING TWO SHEET FEED MECHANISMS THAT CAN OPERATE AT DIFFERENT SPEEDS

FIELD OF THE INVENTION AND RELATED ART STATEMENT

The present invention relates to a printer provided with two sheet feed mechanisms.

Referring to FIG. 4, a conventional printer of such a type has a printing unit 1 comprising an image carrying member 2, a charger 3, an optical system 4, a developing unit 5 and a transfer unit 6.

A first sheet feed mechanism 10 comprises a first sheet container 11, and a first transportation unit 21 including a pickup roller 22, a plurality of rollers 23 (23*a*, 23*b* and 23*c*) and a motor 25. The first sheet feed mechanism 10 feeds a sheet from the first sheet container 11 to the printing unit and ejects the sheet to a delivery tray 9. Generally, the rollers 23*a*, 23*b* and 23*c* are driven through a power transmission mechanism 26 comprising shafts, pulleys and associated parts by the motor 25.

A second sheet feed mechanism 30 comprises a second sheet container 31, and a second transportation unit 41 including a pickup roller 42 and rollers 43 (43*a* and 43*b*). The second sheet feed mechanism 30 feeds a sheet from the second sheet container 31 through a secondary transportation path 49 to the first transportation unit 21 of the first sheet feed mechanism 10. The roller 23*a* is disposed at the junction of the first sheet transportation unit 21 and a sheet transportation path along which a sheet fed from the second sheet container 31 is transported to feed the sheet to the printing unit 1.

Generally, the second transportation unit 41 is driven by the motor 25 of the first transportation unit 21. The second transportation unit 41 is interlocked with the motor 25 by an interlocking mechanism 47 comprising a driving gear 46*a*, a driven gear 46*b* and a power transmission mechanism 46*c*.

Accordingly, the second transportation unit 41 is driven through the interlocking mechanism 47 for sheet transportation at a transportation speed V2 when the first transportation unit 21 is driven for sheet transportation at a predetermined transportation speed V1. Therefore, the sheets contained in the first sheet container 11 are fed one at a time when the pickup roller 22 is actuated selectively. When the pickup roller 42 is actuated selectively, the sheets contained in the second sheet container 31 are fed one at a time through the secondary transportation path 49 to the printing unit 1 by the first transportation unit 21 including the rollers 23*a* and 23*b*. Thus, a plurality of kinds of sheets can selectively used for printing.

Since the second transportation unit 41 is driven through the interlocking mechanism 47 by the motor 25 of the first transportation unit 21, the sheet transportation speed V2 of the second transportation unit 41 is dependent on the sheet transportation speed V1 of the first transportation unit 21. It has been usual to design the power transmission mechanism 26 and the interlocking mechanism 47 so that the transportation speed V2 is equal to the transportation speed V1.

However, the conventional printer of such a construction has encountered problems in the further enhancement of the speed of printing operation.

The distance of transportation between the second sheet container 31 and the roller 23*a* of the first transportation unit 21 is different from that between the first sheet container 11 and the roller 23*a* because the second sheet container 31 is connected to the first transportation unit 21 by the secondary transportation path 49.

Accordingly, if the transportation speed V2 of the second sheet feed mechanism 30 is equal to the transportation speed V1 of the first sheet feed mechanism 10, a time in which a sheet taken out from the second sheet container 31 by the pickup roller 42 is delivered to the printing unit 1 for printing is significantly longer than a timer in which a sheet taken out from the first sheet container 11 is delivered to the printing unit 1 for printing, which impedes the further enhancement of the speed of printing operation.

According to a proposal disclosed in Japanese Patent Laid-open (Kokai) No. Sho 62-157149, the respective diameters of the rollers 23 of the first transportation unit 21 and the rollers 43 of the second transportation unit 41 are determined so that the quotient of division of the diameter of the rollers 23 by the distance of transportation of a sheet fed from the first sheet container 11 is equal to the quotient of division of the diameter of the rollers 43 by the distance of transportation of a sheet fed from the second sheet container 31 to deliver the sheet fed from the second sheet container 31 to the roller 23*a* in a time equal to that in which the sheet fed from the first sheet container 11 is delivered to the roller 23*a*. However, if this proposal is practiced, the transportation speed V2 of the second sheet feed mechanism 30 is considerably higher than the transportation speed V1 of the first sheet feed mechanism 10. Consequently, the sheet fed from the second sheet container 31 may be creased or jammed in the secondary transportation path 49 because the second transportation unit 41 continues driving the sheet at the transportation speed V2, which is higher than the transportation speed V1, toward the roller 23*a* after the leading edge of the sheet fed from the second sheet container 31 has arrived at the roller 23*a* of the first transportation unit 21.

OBJECT AND SUMMARY OF THE INVENTION

Accordingly, it is an object of the present invention to provide a printer capable of rapidly transporting a sheet from any one of a plurality of sheet containers for high-speed printing operation without entailing jamming.

In one aspect of the present invention, a printer comprises a first sheet feed mechanism comprising a first sheet container and a first transportation unit capable of transporting a sheet taken out from the first sheet container at a predetermined transportation speed, and a second sheet feed mechanism comprising a second sheet container and a second transportation unit for transporting a sheet taken out from the second sheet container to the first transportation unit. The printer is characterized in that the first sheet feed mechanism is provided with a sheet detector for detecting the reception of a sheet taken out from the second sheet container by the first sheet feed mechanism, and the second sheet feed mechanism is controlled by a speed controller so that the sheet feed speed of the second sheet feed mechanism is higher than that of the first sheet feed mechanism before the sheet detector detects the leading edge of a sheet fed from the second sheet container and the sheet feed speed of the second sheet feed mechanism is reduced below the sheet feed speed of the first sheet feed mechanism upon the detection of the leading edge of the sheet fed from the second sheet container. If the second sheet feed mechanism is selected, the second sheet feed mechanism feeds a sheet at a feed speed higher than that of the first sheet feed mechanism until the leading edge of the sheet is detected by the sheet detector. Upon the detection of the leading edge of the sheet by the sheet detector, the sheet feed speed of the second sheet feed mechanism is reduced below the sheet feed speed of the first sheet feed mechanism.

Accordingly, either the sheet of the first sheet container or that of the second sheet container can be delivered to the first sheet feed mechanism in a fixed time and can be subjected to printing in a fixed time.

Since the sheet feed speed of the second sheet feed mechanism is reduced below the sheet feed speed of the first sheet feed mechanism upon the insertion of the leading edge of the sheet of the second sheet container into the first transportation unit, the second transportation unit does not drive the sheet forcibly into the first transportation unit, so that the sheet is neither creased nor jammed.

Thus, either the sheet of the first sheet container or that of the second sheet container can be transported rapidly to enable the printer to operate for high-speed printing.

DETAILED DESCRIPTION OF THE PREFERRED EMBODIMENT

Figure 4:
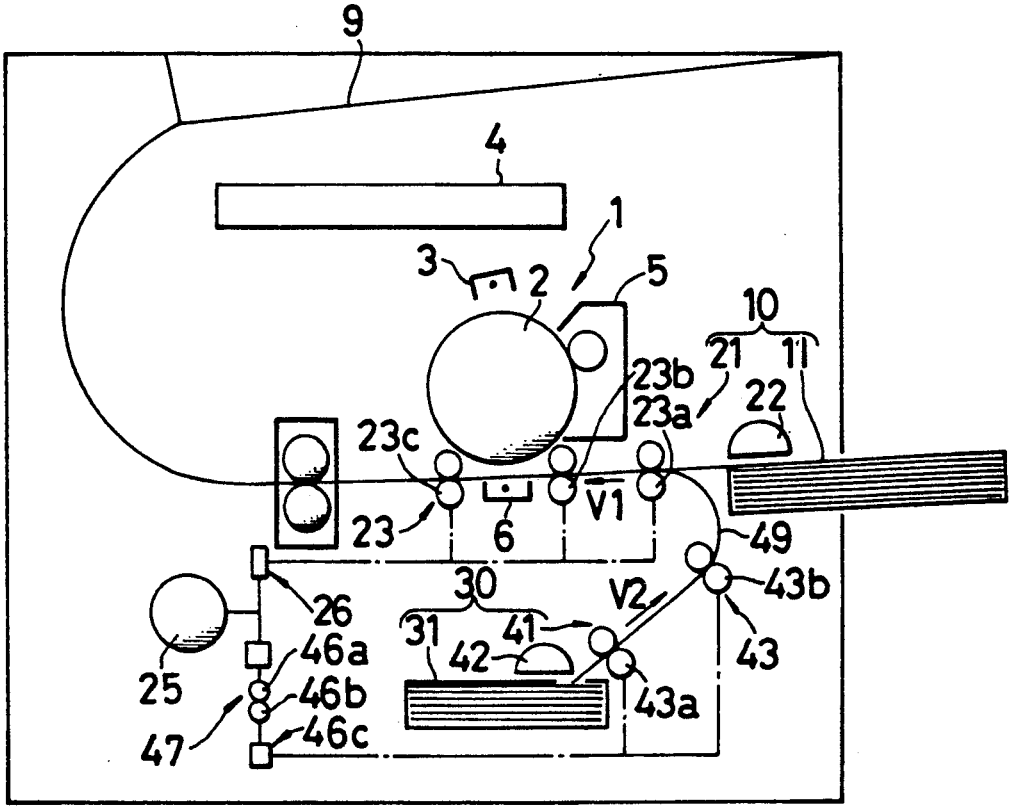
FIG. 4 PRIOR ART
FIG. 4 is a diagrammatic view of a conventional printer.

A printer in a preferred embodiment according to the present invention will be described with reference to the accompanying drawings, in which parts like or corresponding to those of the conventional printer previously described with reference to FIG. 4 are denoted by the same reference characters and will be described briefly or the description thereof will be omitted.

Figure 1:
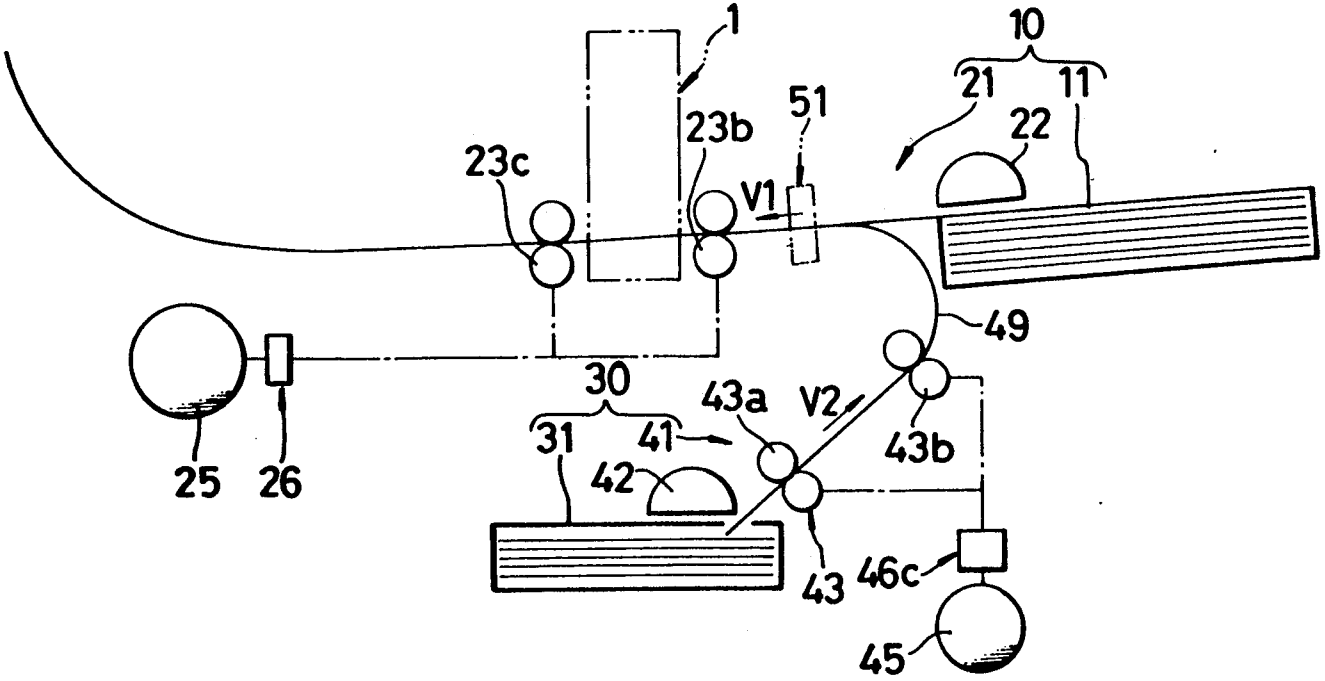
FIG. 1 is a diagrammatic view of a printer in a preferred embodiment according to the present invention.

Referring to FIG. 1, a printer comprises: a first sheet feed mechanism 10 comprising a first sheet container 11, a pickup roller 22, and a first transportation unit 21 including rollers 23 (23*b* and 23*c*), a power transmission mechanism 26 for transmitting the output power of a main motor 25 to the first transportation unit 21, and a sheet detector 51, such as a photoelectric sensor; a second sheet feed mechanism 30 comprising a second sheet container 31, a pickup roller 42, and a second transportation unit 41 including rollers 43 (43*a* and 43*b*), an auxiliary motor 45, and a power transmission mechanism 46*c* for transmitting the output power of the auxiliary motor 45 to the rollers 43; and a speed controller 60 for controlling the respective sheet feed speeds V1 and V2 of the first sheet feed mechanism 10 and the second sheet feed mechanism 30.

The sheet detector 51 detects the reception of a sheet fed from the second sheet container 31 by the first sheet feed mechanism 10. The auxiliary motor 45 drives the second sheet feed mechanism 30 individually. The speed controller 60 controls the second sheet feed mechanism 30 so that the sheet feed speed V2 of the second sheet feed mechanism 30 is a predetermined first speed higher than the sheet feed speed V1 of the first sheet feed mechanism 10 before the sheet detector 51 detects a sheet fed from the second sheet container 31 and the sheet feed speed V2 is a predetermined second speed lower than the sheet feed speed V1 of the first sheet feed mechanism 10.

When a sheet fed from the second sheet container 31 is transported at the first speed along a second sheet feed path of a length greater than that of a first sheet feed path along which a sheet fed from the first sheet container 11 is transported, the sheet fed from the second sheet container 31 reaches the first transportation unit 21 of the first sheet feed mechanism 10 in a time equal to a time in which a sheet fed from the first sheet container 11 reaches the first transportation unit 21.

Figure 2:
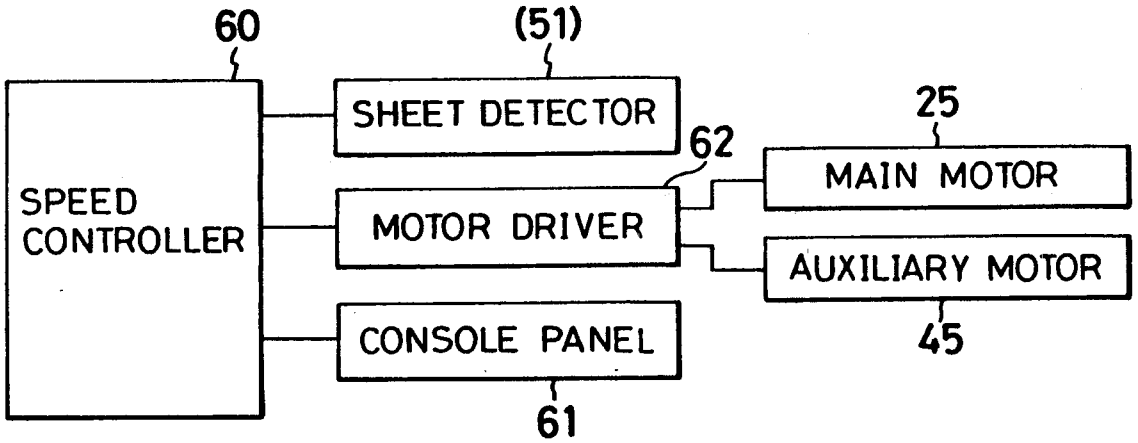
FIG. 2 is a block diagram of an electric system included in the printer of FIG. 1.
Figure 3:
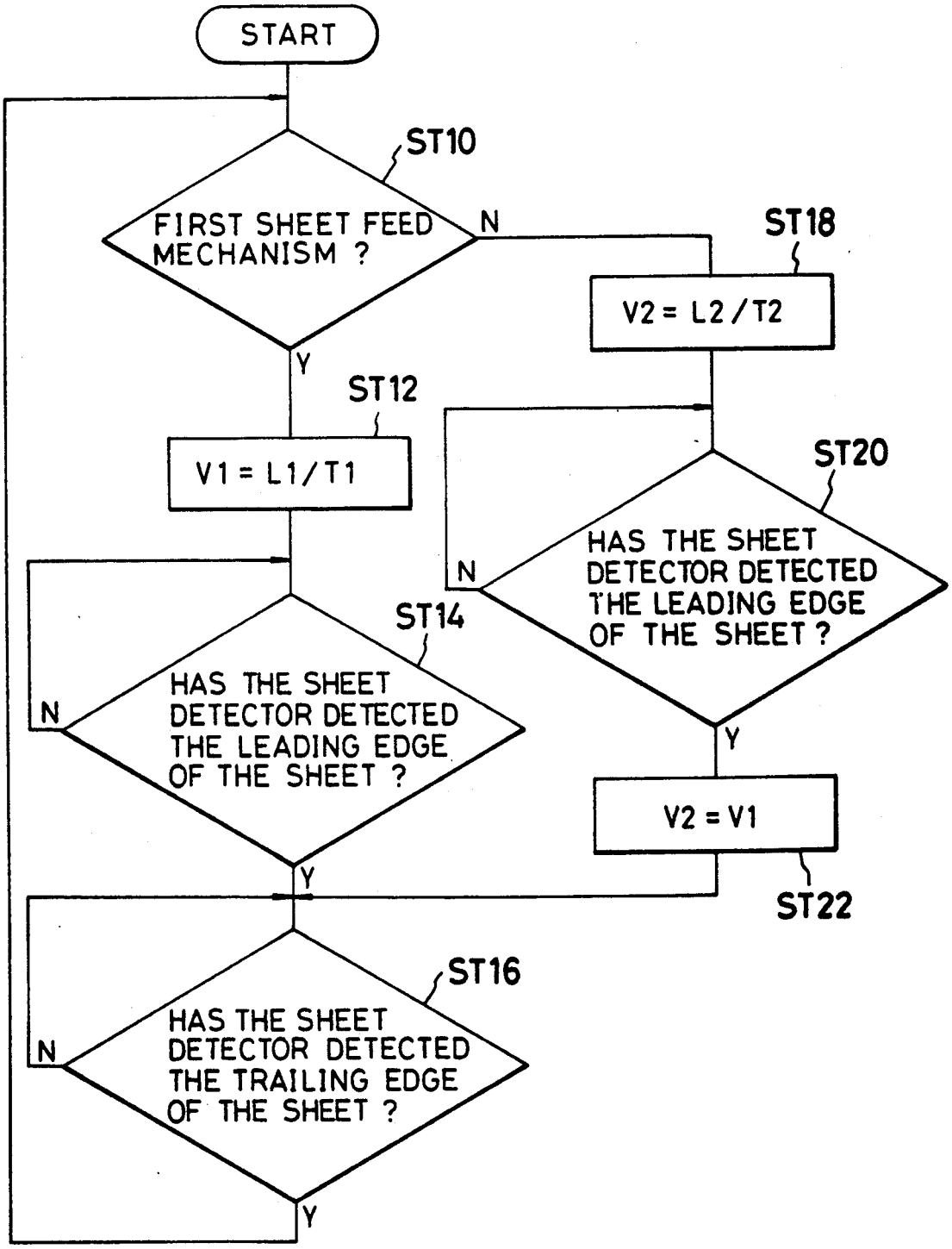
FIG. 3 is a flow chart of a control procedure to be executed by a controller included in the printer of FIG. 1.

Referring to FIG. 2, the sheet detector 51, a console panel 61, a motor driver 62, the motor 25 and the auxiliary motor 45 are connected to the speed controller 60. A speed control program shown in FIG. 3 is stored in the speed controller 60. Naturally, the speed control program may be executed by a main controller including a CPU, a ROM and a RAM for controlling the printer.

The operation of the printer will be described hereinafter with reference to FIG. 3.

In step ST10, a query is made to see if the console panel 61 is operated to select the first sheet feed mechanism 10. If the response in step ST10 is affirmative, namely, if the first sheet feed mechanism 10 is selected, the speed controller 60 controls the motor driver 62 in step ST12 to drive the main motor 25 so that the feed speed V1 of the first sheet feed mechanism 10 is equal to L1/T1, where L1 is the length of a sheet transportation path between the first sheet container 11 and the first transportation unit 21 (the sheet detector 51), and T1 is a time in which the leading edge of a sheet fed from the first sheet container 11 reaches the sheet detector 51.

Then, the sheet fed from the first sheet container 11 is transported by the first transportation unit 21. After both the leading edge and trailing edge of the sheet have been detected by the sheet detector 51 (steps ST14 and ST16), the program returns to step ST10.

If the response in step ST10 is negative, namely, if the second sheet feed mechanism 30 is selected, the speed controller 60 controls the motor driver 62 in step ST18 to drive the auxiliary motor 45 so that the feed speed V2 of the second sheet feed mechanism 30 is equal to L2/T1, where L2 is the length of a sheet transportation path between the second sheet container 31 and the first transportation unit 21 (the sheet detector 51). Since the length L2 is greater than the length L1, the feed speed V2 is greater than the feed speed V1.

In step ST20, a query is made to see if the sheet detector 51 has detected the leading edge of the sheet fed from the second sheet container 31 and transported through a second transportation path 49. If the response in step ST20 is affirmative, the speed controller 60 controls the motor driver 62 to drive the auxiliary motor 45 so that the feed speed V2 of the second sheet feed mechanism 30 is not higher than the feed speed V1 of the first sheet feed mechanism 10 (in this embodiment, V1=V2); consequently, the second transportation unit 41 is able to drive the sheet fed from the second sheet container 31 without creasing or jamming the same in the second transportation path 49.

Upon the detection of the trailing edge of the sheet transported by the second sheet feed mechanism 30 by the sheet detector 51 (step ST16), the program returns to step ST10.

Thus, the sheet fed from the first sheet container 11 in the sheet fed for the second sheet container 31 can be smoothly delivered to the roller 23*b* in the same length of time.

As stated above, the sheet detector 51 detects the insertion of a sheet fed from he second sheet container 31 into he first sheet fed mechanism 10, the speed controller 60 adjusts the feed speed V2 of the second sheet feed mechanism 30 to the first feed speed higher than the feed speed V1 of the first sheet feed mechanism 10 before the sheet detector 51 detects the leading edge of the sheet fed from the second sheet feed mechanism 30 and adjusts the feed speed V2 to the second feed speed not higher than the feed speed V1 of the first sheetfeed mechanism 10 upon the detection of the leading edge of the sheet by the sheet detector 51. Therefore, either the sheet fed from the first sheet container 11 or the sheet fed from the second sheet container 31 can be rapidly transported fort high-speed printing operation without jamming the sheet in the transportation path regardless of the difference between the length of the transportation path between the first sheet container 11 and the first transportation unit 21 and the length of the transportation path between the second sheet container 31 and the first transportation unit 21.

As is apparent from the foregoing description, according to the present invention, the sheet detector detects the insertion of the sheet fed from the second sheet container into the first sheet feed mechanism, and the speed controller adjusts the feed speed of the second sheet feed mechanism to the first feed speed higher than the feed speed of the first sheet feed mechanism before the sheet detector detects the leading edge of the sheet fed from the second sheet container and adjusts the feed speed of the second sheet feed mechanism to the second feed speed not higher than the feed speed of the first sheet feed mechanism upon the detection of the leading edge of the sheet by the sheet detector. Accordingly, either the sheet fed from the first sheet container or the sheet fed from the second sheet container can be rapidly transported for high-speed printing operation without being jammed in the transportation path.

What is claimed is:

1. A printer comprising:

a first sheet feed mechanism comprising a first sheet container, and a first transportation unit for transporting a sheet fed from the first sheet container at a predetermined feed speed; and a second sheet feed mechanism comprising a second sheet container, and a second transportation unit for transporting a sheet fed from the second sheet container to the first sheet feed mechanism;

characterized in that the first sheet feed mechanism is provided with a sheet detector for detecting the insertion of a sheet fed from the second sheet container into the first sheet feed mechanism, and a speed controller adjusts the feed speed of the second sheet feed mechanism to a predetermined first feed speed higher than the feed speed of the first sheet feed mechanism before the sheet detector detects the leading edge of the sheet fed from the second sheet container and adjusts the feed speed of the second sheet feed mechanism to a predetermined feed speed not higher than the feed speed of the first sheet feed mechanism upon the detection of the leading edge of the sheet fed from the second sheet container by the sheet detector.

2. A printer according to claim 1, wherein the first transportation unit of the first sheet feed mechanism has a straight sheet transportation path, and the second transportation unit of the second sheet feed mechanism has a curved sheet transportation path merging into the straight sheet transportation path of the first transportation unit.

3. A printer according to claim 1, wherein the sheet detector is disposed right behind the junction of the sheet transportation path of the first transportation unit and the sheet transportation path of the second transportation unit.

4. A printer according to claim 1, wherein the first sheet feed mechanism and the second sheet feed mechanism are driven individually respectively by individual driving means.

5. A printer comprising:

a first sheet feed mechanism comprising a first sheet container, and a first transportation unit for transporting a sheet fed from the first sheet container at a predetermined feed speed; and a second sheet feed mechanism comprising a second sheet container, and a second transportation unit for transporting a sheet fed from the second sheet container to the first sheet feed mechanism;

characterized in that the first sheet feed mechanism is provided with a sheet detector for detecting the insertion of a sheet fed from the second sheet container into the first sheet feed mechanism, and a speed controller adjusts the feed speed of the second sheet feed mechanism to a predetermined first speed higher than the feed speed of the first sheet feed mechanism before the sheet detector detects the leading edge of the sheet fed from the second sheet container and adjusts the feed speed of the second sheet feed mechanism to a second feed speed equal to the feed speed of the first sheet feed mechanism upon the detection of the leading edge of the sheet fed from the second sheet container.

* * * * *